United States Patent [19]

Jernberg

[11] Patent Number: 4,921,214

[45] Date of Patent: May 1, 1990

[54] NON-REFILLABLE PACKLESS VALVE FOR PRESSURIZED CONTAINERS

[75] Inventor: Robert H. Jernberg, East Hampton, Conn.

[73] Assignee: Amtrol Inc., West Warwick, R.I.

[21] Appl. No.: 363,074

[22] Filed: Jun. 8, 1989

Related U.S. Application Data

[63] Continuation-in-part of Ser. No. 353,611, May 18, 1989, abandoned.

[51] Int. Cl.[5] ..... B65D 47/02

[52] U.S. Cl. ..... 251/335.2; 251/64; 251/82; 222/147

[58] Field of Search ..... 137/315, 316, 514; 251/335.2, 82, 144, 64; 222/509, 559, 147

[56] References Cited

U.S. PATENT DOCUMENTS

| | | | |
|---|---|---|---|
| 390,522 | 9/1975 | Karenfeld | 137/484 |
| 871,780 | 11/1907 | Card | 215/21 |
| 1,305,747 | 6/1919 | Sechrist | 137/539.5 |
| 2,524,129 | 10/1950 | Klein | 251/144 |
| 2,630,290 | 3/1953 | Courtot | 251/335.2 |
| 2,710,021 | 6/1955 | Jones | 137/514.5 |
| 2,895,497 | 7/1959 | Jones | 137/316 |
| 2,933,284 | 4/1960 | Yocum | 251/278 |
| 3,053,499 | 9/1962 | Jones | 251/284 |
| 3,111,141 | 11/1963 | Hughes | 137/630.22 |
| 3,396,940 | 8/1968 | Jones | 251/335 |
| 3,420,493 | 1/1969 | Kraft | 251/82 |
| 3,552,421 | 1/1971 | Yocum | 137/321 |
| 3,669,407 | 6/1972 | Mundt et al. | 251/334 |
| 3,700,207 | 10/1972 | Bartlett | 251/88 |
| 3,704,813 | 12/1972 | Devol | 222/147 |
| 3,759,294 | 9/1973 | Kongelka | 137/612.1 |
| 3,782,858 | 1/1974 | Deters | 417/26 |
| 3,871,792 | 3/1975 | Gritz | 417/38 |
| 3,876,336 | 4/1975 | Nash | 417/38 |
| 3,922,111 | 11/1975 | Deters | 417/26 |
| 3,970,285 | 7/1976 | Lonn | 251/214 |
| 3,985,332 | 10/1976 | Walker | 251/111 |
| 4,049,017 | 9/1977 | Jones | 137/540 |
| 4,254,792 | 3/1981 | Schadel | 137/240 |
| 4,543,980 | 10/1985 | van der Sanden | 137/315 |
| 4,573,611 | 3/1986 | O'Connor | 222/147 |
| 4,597,559 | 7/1986 | Kirk | 251/144 |
| 4,766,927 | 8/1988 | Conatser | 137/315 |
| 4,813,575 | 3/1989 | O'Connor | 251/82 |

FOREIGN PATENT DOCUMENTS

| | | |
|---|---|---|
| 2536818 | 2/1984 | France . |
| 3337197 | 1/1985 | France . |
| 2088317 | 6/1982 | United Kingdom . |
| 2133502 | 11/1984 | United Kingdom . |

*Primary Examiner*—A. Michael Chambers
*Attorney, Agent, or Firm*—Fisher, Christen & Sabol

[57] ABSTRACT

A packless non-refillable valve which incorporates a diaphragm.

10 Claims, 4 Drawing Sheets

NON-REFILLABLE PACKLESS VALVE FOR PRESSURIZED CONTAINERS

This is a continuation-in-part of U.S. application Ser. No. 353,611, filed on May 18, 1989, applicant: Robert H. Jernberg, title: "Non-Refillable Packless Valve For Pressurized Containers", now abandoned.

BACKGROUND OF THE INVENTION

1. Field of the Invention

The invention relates to non-refillable or single use packless valves for pressurized systems. The valve includes a valve housing mounted on a container, and a valve body, movable in the housing by means of a handle, communicating with an elastomeric diaphragm, to allow and prevent release of fluid from the container. A nozzle is provided for venting fluid from the container.

2. Background Art

Pressure tanks or other pressure containers are usually filled under carefully controlled conditions at a charging station and then distributed to various places for use. Unfortunately, the attractive economies of refilling containers at points of use or otherwise repressurizing them under less than carefully supervised conditions has resulted, in the less consequential cases, in the introduction of impurities or inferior refills and, in the more consequential cases, to injurious explosions. The reuse of pressure containers is highly objectionable for many reasons which relate to safety.

U.S. application Ser. No. 102,329, filed on Sept. 29, 1987, now U.S. Pat. No. 4,813,575 issued Mar. 21, 1989, discloses a non-refillable valve for a pressure container which includes a housing with a central bore which has a lower portion that is narrower than its middle portion which, in turn, is narrower than its upper portion. A side port is present in the lower region of the middle portion and an outlet nozzle is attached to the side port. The lower end of the housing is adapted to sealingly engage the pressure container to provide communication therebetween. The valve stem is rotatably positioned in the upper portion of the central bore. The valve stem contains a vertical bore in its bottom portion. A resilient valve sealing member has a body portion and a top pin which slidably fits into the bore in the valve stem. The sealing member has a top rim portion which has a continuous outer surface and does not have any slots, indentations or the like. Also, the body portion does not have any arm or arms (particularly around its periphery). The top rim portion of the sealing member is comprisingly positioned in the upper portion of the central bore when the valve is inactive or being filled. The valve sealing member is pushed into the middle portion by means of the valve stem when the valve is placed in the active position. The non-compressed top rim of the sealing member is wider than the upper portion of the central bore, which prevents movement of the sealing member back into the upper portion of the central bore. The sealing member engages the seating interface when any refill of the container with pressurized fluid is attempted.

U.S. Pat. No. 4,573,611 discloses a non-refillable valve for a pressure container which includes a housing. The housing has a central bore which has a lower portion that is narrower than the middle portion of the central bore and which has an upper portion that is narrower than the middle portion of the central bore. A side port is present which communicates with the lower region of the middle portion of the central bore. The lower end of the housing is adapted to sealingly engage the pressure container in a manner which provides communication between the pressure container and the lower portion of the central bore. There is an outlet nozzle, having a bore lengthwise therethrough, which is positioned on the side of the housing which is in communication with the middle portion of the central bore via the side port in the housing. Valve stem means is positioned in the upper portion of the central bore in a rotatable manner which advances the valve stem means back and/or forth in the central bore. A tube is mounted on the internal end of the valve stem means which extends into the middle portion of the central bore. There is also a resilient valve sealing member which has a body portion and an upper flange that extends upwardly and outwardly from the body. A longitudinal passageway is present in the body portion, the bottom portion of the longitudinal passageway not extending through the bottom of the body portion. A vertical post is positioned in the middle of the longitudinal passageway, thereby forming a slot around the vertical post. The post slidingly engages the tube on the bottom of the valve stem means. The flange portion of the sealing member is compressingly positioned in the upper portion of the central bore when the valve is inactive or being filled. The valve sealing member is pushed into the middle portion by means of the valve stem means when the valve is placed in the active position. The valve sealing member is seated against the interface between the middle and lower portions of the central bore when the valve is closed. The sealing member is positioned in the middle chamber above the seating interface when the valve is used for discharge of the container. The sealing member sealingly engages the seating interface when refill of container with pressurized fluid is attempted.

U.S. Pat. No. 4,543,980 discloses a valve for a pressurized container having a blocking element therein which is adapted to occupy an initial location in which fluid can move in and out of the container past the blocking element. The valve and blocking element are further configured such that the blocking element can be irreversibly moved to a position in which the valve permits escape of fluid under pressure exerted from the inside of the container, but which automatically closes in response to exposure to an external pressure greater than the pressure inside the container. The blocking element is formed of at least one flexible, radially extending arm whose lateral radius is reduced upon movement of the blocking element from the initial location to the final location. The at least one arm expands within the final location to prevent return of the blocking element to the initial location.

German Published Patent Application No. 3,337,197 discloses non-refillable valves with a blocking element having at least one flexible arm. German '197 is a priority application of U.S. Pat. No. 4,543,980. German '197 also discloses embodiments of non-refillable valves which utilize ball-shaped sealing elements.

British Published Patent Application No. 2,133,502 and French Published Patent Application No. 2,536,818 appear to correspond to German Published Patent Application No. 3,337,197.

U.S. Pat. No. 3,704,813 discloses a fluid dispersing valve assembly having a body, one end of which is formed for securement to a container. The body forms a conduit having only one through passage for filling and discharging fluid. There is a shut-off valve operable for controlling the flow of fluid through the passage. The shut-off valve has an externally accessible control. There is convertible means in the body comprising an initially inactive check valve initially in condition to accommodate the flow of fluid through the passage in both the filling and discharge directions. The check valve is convertible after an initial filling operation into an active check valve in the passage in series with the shut-off valve. The initially inactive check valve includes a movable valve member, a valve seat, means for biasing the valve member toward the valve seat, and detent means effective initially to prevent the cooperation of the valve member with the valve seat. The detent means is defeatable after an initial filling operation to enable the valve member to engage the seat. The check valve, when active, is operative to pass fluid only in the discharge direction. The check valve, after being rendered active to obstruct the flow of fluid selectively in the filling direction, is guarded against access from the exterior of the valve assembly when secured to a container for reopening the passage to the flow of fluid in the filling direction. Thereby, a container equipped with the valve assembly can be evacuated and then filled with fluid in the initial condition of the valve assembly, but is substantially non-refillable after conversion of the convertible means.

U.S. Pat. No. 3,985,332 discloses a non-refillable safety valve for a pressure container. The valve includes a housing having a central bore which provides communication between a port and the pressure container for charging and selectively discharging the pressure container. The central bore has a lower portion that is narrower than the upper portion of the central bore. A hollow knob unit, having a central bore, is in threaded engagement with the outer wall of the housing. A core, having a central bore, is slidably mounted in the central bore of the housing. The upper end of the hollow knob unit is mounted on the core in a rotatable manner and in fixed longitudinal relationship with the core. A sealing member is slidably mounted in the lower end portion of the central bore of the core. The core contains end stop means for preventing movement of the sealing member below the lower end of the core. The sealing member engages the central bore of the housing when the core is moved the maximum possible distance into the central bore of the core or when refill is attempted after discharge of the pressure container. The core contains at least one passageway located in the core outward from the sealing member for communication between the central bore of the core and the upper portion of the central core of the housing. An engagable stop means is positioned between the outer surface of the housing and the inner surface of the hollow knob unit in order to limit retrograde or outward movement of the core to a position whereby the sealing member still engages the interface ledge when refilling the pressure container. The engagable stop means engages after the pressure container has been filled and the sealing member, the core and the knob unit have been moved into sealing position.

U.S. Pat. No. 871,780 discloses a bottle having a neck provided with a passage and having a valve chamber at the inner end of the neck. A valve seat is formed in the chamber. There is a valve operable in the latter and provided with a compressible head adapted to close upon the seat and of greater diameter than the passage. The valve is elastic, and is inserted into the chamber of the bottle by forcing it in deformed shape down the neck of a bottle by means of a mechanism similar to a screw press. The bottle is inserted into the press box and the screw is used to force the deformed valve down the bottle neck. The valve mechanism is used to prevent fraudulent substitution of contents; use with pressurized fluids is not mentioned.

U.S. Pat. No. 3,782,858 describes a control apparatus for a water supply system. The control apparatus has a motor-operated pump for pumping water through a delivery line to one or more valved outlets. The control apparatus includes a pressure switch response to the pressure in the delivery line and operable at preselected upper and lower pressure limits to respectively stop and start the pump motor, and a valve which regulates the flow from the pump to the delivery line to maintain the pressure in the line substantially constant at a valve intermediate the upper and lower pressure limits during normal flow from the delivery line, with a bypass for passing a restricted flow of fluid into the delivery line, when the flow from the delivery line is shut off and the valve is closed, to increase the pressure in the delivery line and operate the switch to shut off the pump motor. The diaphragm also functions as a small expansion chamber to limit the frequency at which the control apparatus will cycle the pump motor, when water is drawn from the delivery line at a rate below the bypass rate, and provision is made for controlling the expansion and contraction of the diaphragm in a manner to effect a rapid increase in pressure into the delivery line to shut off the pump motor, when flow from the delivery line is terminated.

U.S. Pat. No. 3,902,522 describes a pressure reducer. This fluid pressure reducer has an inlet and outlet chamber connected by a passageway which also provides a valve seat. An annular wall extends into the passageway short of the valve seat to provide a constriction. The valve seat is closable by a valve member carried by a spindle to which is secured a relief piston which rides in the annular wall. The end of the annular wall removed with respect to the valve seat is closed by a spring-loaded diaphragm to provide an after pressure chamber which communicates with the outlet chamber by means of a bore. The spindle extends through the diaphragm in a sealed relationship.

U.S. Pat. No. 1,305,747 describes a safety valve. This safety valve is used in sanitary systems. The valve includes a member having a passage therethrough and a seat for a ball valve. Detachably connected with the seat member is a casing carrying a removable spring-pressed plunger, the inner end of which bears against the ball and controls the pressure in the cooling vessel. The spring is so housed that steam or water escaping through the valve will not come into contact with it. The upper part of the casing is arranged to provide a seat for the ball valve when in its upper position, thus cutting off passage of steam or water above the valve and into the spring housing. Steam escapes through apertures in the casing at the side of the housing.

British Patent No. 2,088,317 describes a bottle stopper for preventing illicit refilling. A stopper for insertion into the mouth of the bottle has a passage in which a valve member is provided to close the passage when the bottle is upright to prevent illicit refilling. Side walls prevent tampering with the member while seal inhibits and indicates removal of the stopper. The stopper may be molded in two or more pieces, and the member may be of spherical, mushroom or other shape. A tubular plug may be inserted in the upper end of the stopper to provide a tighter fit in the mouth of the bottle.

U.S. Pat. No. 4,597,559 discloses, in combination, a container for pressurized gas and a diaphragm valve, the container having a port in the wall thereof. The diaphragm valve has an elongated member body having an elongated central passageway, and a flexible diaphragm positioned in and sealingly affixed to the sides of the elongated central passageway of the elongated body member. The second end opening of the elongated member is axially aligned with the port of the container. The diameter of the central passageway of the elongated central passageway is greater than the diameter of the port of the container. The second end of the elongated member is an outwardly extending surface which is sealingly affixed to the outside surface of the wall of the container around the port of the container. The diaphragm forms a first chamber and a second chamber in the elongated central passageway of the elongated body member. The plane of the diaphragm is perpendicular to the longitudinal axis of the elongated central passageway of the elongated body member. A valve stem is rotatably positioned in the first chamber in a manner whereby the valve stem can be moved toward or away from the diaphragm. The first end of the valve stem protrudes out of the first chamber. Means for rotating the valve stem is affixed on the first end of the valve stem. There is a port located in the side of the elongated member, which communicates with the second chamber of the elongated member. There is also a short member having a central passageway, which has its first end affixed in the port. The second end of the short member is adapted to be connected to a source of pressurized gas. A second elongated member having a central passageway, is positioned in the second chamber of the first elongated member. The second end of the elongated member extends through the port of the container. The second end of the second elongated member is an outward extending surface which is sealingly affixed to the inside of the wall of the container around the port of the container; the first end of the second elongated member forms a valve seat. The valve seat is positioned near but not in contact with the diaphragm. The end of the first elongated member corresponds to the second end port of the first elongated member and is adapted to be sealingly affixed to a container for compressed gas. There is a member having a central chamber which is open on one end and which has a flat bottom portion. The cup member is positioned in the first chamber of the first elongated member. The bottom portion of the cup member contacts, or is capable of contacting, the flat bottom portion of the cup member. There is a route of communication from the second end of the short member through the central passageway of the short member, the second chamber of the first elongated member and the central passageway of the second elongated member to the second end of the second elongated member. The diaphragm valve is capable of being moved into a closed position by rotating the valve stem inwardly, whereby the flat bottom portion of the cup member sealingly presses the diaphragm against the valve seat of the second elongated member and thereby the route of communication is sealingly interrupted. Preferably, a spring is positioned in the central passageway of the elongated member. The spring contacts the diaphragm and normally holds the diaphragm in the open position.

U.S. Pat. No. 4,049,017 discloses a relief valve particularly suited for interior use in refrigeration systems. The valve includes a valve body having an inlet, an outlet, and a passageway therebetween with a valve seat positioned in the passageway. Inside of the passageway are mounted an adjustable valve spring retainer, a coil valve spring, a valve piston including a fluorocarbon sealing surface thereon, and a bearing means mounted between one end of the valve spring and either the retainer or valve piston. The spring retainer is adjusted by turning in its threaded mounting. The bearing means prevents the turning movement applied to the retainer from extending to the valve piston. Any rotational relation between the piston sealing surface and seat which would be deleterious to the sealing engagement is eliminated.

U.S. Pat. No. 3,552,421 discloses a valve apparatus suitable for, but not limited to use upon one-trip, throw-away fluid containers. A valve body is fitted to the container and has a bore with a port in the end for withdrawal of fluid from the container. A valve head threads into the bore to close the port. A separate member closes the bore and encloses a stem so that the valve head can be operated to open the port and permit controlled discharge of fluid from the container.

U.S. Pat. No. 3,396,940 discloses a diaphragm-type valve which includes a valve body provided with inlet and outlet ports in communication with each other through an interposed valve seat. There is a valve element in the valve body including sealing means movable into engagement with the valve seat to interrupt fluid communication between the ports, a valve bonnet joined to the valve body, and a valve stem threadedly mounted in the valve bonnet for rotational and reciprocating movement within the valve body. The valve stem at its inner end is engaged with the sealing means to move the same toward and away from the valve seat. The sealing means includes diaphragm means sub-dividing the interior of the valve body into a stem-receiving area and a fluid flow area wherein the valve seat is located. There is also a flexible impervious cup-like seal cap means having an enlarged open end fluidtightly received around a portion of the valve bonnet, and an opening in the cup-like seal cap means through which the valve stem fluid tightly extends. The diaphragm means and the cup-like impervious seal cap means define with said bonnet a volume which remains substantially constant regardless of the position of the valve stem.

Various diaphragm valves are made and distributed by Henry Valve Company, Melrose Park, Ill., Superior Valve Company, Washington, Pa., and Hoke Valve Co., Cresskill, N.J.

There is a need for a relatively simple and inexpensive valve which will allow normal filling of the pressure container under proper conditions, adequate sealing of the pressure container during nonuse, selective discharge of the pressure container, and effective prevention of improper and unauthorized refilling of the container.

Check valves are old in the art. Concerning the flow of gases, U.S. Pat. No. 2,524,129 discloses a check valve wherein the top outside portion of valve 25 is cylindrical (24) and the bottom outside portion of valve 25 is therefore frustoconical in shape. Valve 25 also has top stem 27. (There are further parts to valve 25.) See the shape of the closure elements in FIGS. 1, 5, 7 and 9 to 11 of British Published Patent Application No.

2,088,317 for non-refillable bottle stoppers. FIGS. 1 and 3 of British '317 show a round closure element and the shaped closure element 39 (although it is substantially hollow).

See also U.S. Pat. Nos. 3,871,792, 3,922,111, 3,669,407, 4,254,792, 2,710,021, 3,970,285, 3,759,294, 3,700,207, 3,111,141, 3,053,499, 3,025,874, 2,933,284, 2,895,497, 3,876,336 and 4,766,927.

BROAD DESCRIPTION OF THE INVENTION

An object of the invention is to provide a non-refillable valve for compressed gas containers, for example, cylinders. Another object of the invention is to provide a non-refillable valve, once activated, which will move freely to permit discharge of the pressurized fluid from the container and which will move automatically to the closed position for preventing the introduction of fluid into the container. A further object of the invention is to provide a comparatively simple, inexpensive, non-refillable valve which, when initially filled and sealed, will permit discharge of the contents of a pressure container, but which will prevent the introduction of further fluid into the container. A still further object of the invention is to provide a non-refillable valve which will prevent refilling of a pressure container even though it is substantially disassembled. Another object of the invention is to provide a non-refillable valve for pressure containers that fulfills the needs of the art regarding such systems. Another object of the invention is to provide a non-refillable valve which is automatically activated in its non-refillable function by placing in its closed position ready for discharge of pressurized fluid from the pressure container it is mounted on. Other objects and advantages of the invention are set out herein or are obvious herefrom to one ordinarily skilled in the art.

The valve of the invention achieves such objects and advantages.

The invention involves a non-refillable valve for a pressure container which includes a housing. The housing has a central bore which has a middle portion, a lower portion that is narrower than the middle portion of the central bore, an upper portion that is narrower than the middle portion of the central bore, and an uppermost portion that is wider than the upper portion of the central bore. A side port is present which communicates with the lower region of the middle portion of the central bore. The lower end of the housing is adapted to sealingly engage the pressure container in a manner which provides communication between the pressure container and the lower portion of the central bore. There is a side or outlet nozzle, having a bore (usually lengthwise) therethrough, which communicates with the atmosphere. The nozzle is positioned on the side of the housing and is in communication with the middle portion of the central bore via the side port in the housing. An insert ring is positioned in the uppermost portion of the central bore. Valve stem means is positioned in the upper portion of the central bore or in the insert ring of the upper portion of the central bore in a rotatable manner by which the valve steam means is advanced back and/or forth in the central bore. There is a diaphragm, having a central hemispherical or curved portion and a rim, the convex portion of the central portion facing the valve stem. The end of the insert ring contacts the rim of the diaphragm so as to hold it in position against the interface between the uppermost portion and the upper portion of the central bore. There is also a resilient valve sealing member which has a lower body portion, an upper extension portion and a centrally-located bore which does not extend through the top of the valve sealing member. The upper extension portion has a top hemispherical, curved or flat (preferred) portion. If the top portion of the valve extension portion is hemispherical or curved portion, it preferably has a mating relationship with the hemispherical or curved portion of the diaphragm. If the top portion of the extension portion is flat, its edge contacts the curved or hemispherical portion of the diaphragm when the valve is in the fill or pre-set state. The lower body portion has a top rim portion which has a lateral dimension which is larger than the lateral dimension of the upper portion of the central bore of the housing and which is less than the lateral dimension of the middle portion of the central bore of the housing. The body portion has a bottom seating portion which is capable of seating at or on the interface of said middle portion and bottom portion of said central bore of said housing. The top rim portion does not contain any gaps, slots, indentations or the like. The body portion does not contain any arms, particularly around its periphery. The top rim portion of the sealing member is compressingly positioned in the upper portion of the central bore when the valve is inactive or being filled. The valve sealing member is pushed into the middle portion by means of the valve stem means via the diaphragm when the valve is placed in the active position. The valve sealing member is seated against the interface between the middle and lower portions of the central bore when the valve is closed. The sealing member is positioned in the middle chamber above the seating interface when the valve is used for discharge of the container, and is guided by the upper chamber of the central bore. The sealing member sealingly engages the seating interface when refill of container with pressurized fluid is attempted.

Preferably the pressure container is a pressurized gas container and preferably the pressurized gas container is a pressurized gas cylinder. The valve stem means can be mounted in the insert ring in the upper portion of the central bore in a screwable manner. Preferably, the valve stem means is mounted in a screwable manner in the upper portion of the central bore above the top of the insert ring. Preferably, the valve stem means is mounted in a screwable manner in the upper portion of the central bore above the top of the insert ring. Preferably, the valve steam means has an externally-located knob for turning the valve stem means. The rim of the diaphragm is preferably outwardly or upwardly and outwardly slanted (preferably about zero to about 60 degrees, most preferably about 30 degrees, to the horizontal), with the lower end of the insert ring and the interface of the uppermost and upper portions of the central bore having slanting arrangements matching that of the diaphragm rim. This slanted arrangement (because of its shape) provides compressive sealing. The affixing arrangement provides in effect a self sealing diaphragm. The higher the pressure the tighter the seal because of shape of the affixing arrangement. The shape of the resilient diaphragm allows the resilient diaphragm to withstand pressures that steel diaphragms cannot withstand. Also, the valve sealing member is made of a resilient material, preferably a resilient plastic. Preferably, the bottom rim of the body portion is bevelled or rounded.

The valve sealing member of the invention valve is not prevented from seating from by any detent which is external to the valve sealing member itself.

In the inactive phase, the valve sealing member is held in the upper portion of the central bore of the valve housing by the means of the compressed, elastic, top rim portion of the valve sealing member. The condition allows the unobstructed passage, formed by the lower and middle portions of the central bore of the housing and the bore of the outlet nozzle, to be used in a filling operation. After the container has been filled and the invention valve is placed in the closed position, the valve sealing member assumes its operative configuration for preventing the flow of fluid into the container in the filling direction. The valve sealing member is virtually inaccessible for tampering to hold it open such as would become necessary for refilling the container.

The invention non-refillable valve does not use any spring means to operate the valve sealing member in any of its functions.

The invention valve has a single line of communication or passageway that serves both for the initial filling operation and subsequently for the controlled discharge of fluid. The valve sealing member is initially not located in that passageway. The valve sealing member is convertible from an initially inactive condition and location utilized during the initial filling operation into its active configuration and location to block subsequent flow in that passage in the filling direction.

When the invention valve is being closed, thus signalling completion of the filling operation, the invention valve automatically causes the valve system to convert to its non-refillable state. The invention valve has a shut-off means that incorporates the valve sealing member to control and/or stop the delivery of fluid from the pressure container. The invention valve is a non-refillable valve that allows one filling and then selective discharging. The invention valve is designed to prevent, and does prevent, the refilling of a pressure container. In this manner, the invention valve allows actual attainment of governmental requirements for a valve that prevents refilling of certain pressure containers.

The invention valve is effective, but relatively simple, and is inexpensive to construct. The invention valve does not use any spring. The design of the invention valve allows more linear motion of the stem valve. The invention valve is fail-proof in the matter of charging, storing and selective discharging. Subsequent filling of the pressure container is prevented by the invention valve.

The non-refillable valve of the invention can be used for fluids, i.e., gases and/or liquids. The fluid can contain solids that are discharged from the pressure vessel as entrained solids, etc. Many forms of liquefiable fluids are sold in disposable containers. Small metal tanks containing liquefied propane, liquefied butane and refrigerants such as FREON are examples. When containers of such type are filled by manufacturer who has full control of the starting condition of the container and of the filling procedures and the specifications, a relatively safe product can be distributed to the public. However, sometimes empty or partly empty containers are collected and these are refilled by poorly skilled and poorly equipped persons. The result is often a hazardous product. The non-refillable valve of the invention prevents such problems and associated dangers.

The sealing element of the invention does not contain any arms (flexible or otherwise) or any slots which have an opening on the top rim portion. The top rim of the invention sealing arm is not an arm. The invention sealing element is basically a body portion (without any peripheral portions which could be interpreted to be flexible, radially extending arms) with a top-mounted stem.

BRIEF DESCRIPTION OF THE DRAWINGS

The preferred embodiments of the invention are shown in the accompanying drawings.

In the drawings.

DETAILED DESCRIPTION OF THE INVENTION

Figure 1:
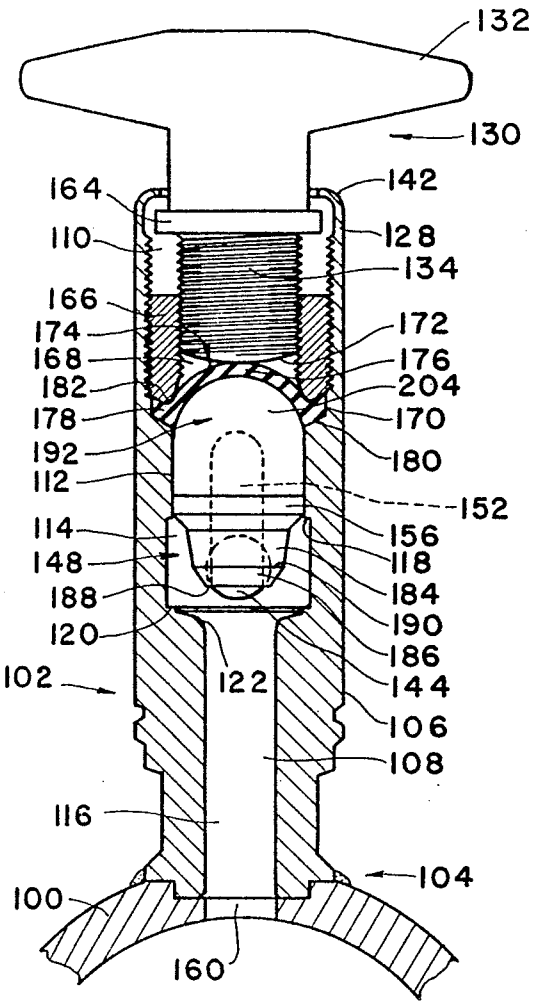
FIG. 1 is a longitudinal cross-sectional view of one embodiment of the non-refillable valve of the invention in its filling position or pre-set position.
Figure 8:
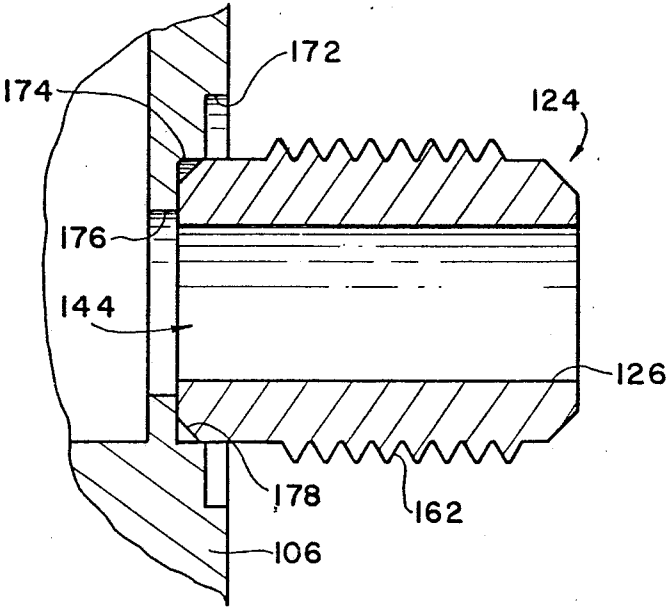
FIG. 8 is a fragmentary cross-sectional view of one version of the side port of the valve of the invention.

Referring to FIG. 1, pressure container or pressure container system 100 is provided with non-refillable valve 102 for the filling and selective emptying of container 100. Valve 102 can be welded, threaded or otherwise affixed to container 100, as shown in FIG. 1 at 104 (the welding mode is shown). The preferred attachment means is set out in FIG. 14. In FIG. 1 valve 102 is provided with housing 106 which has central bore 108. Central bore 108 communicates with the interior of container 100 via hole 160 in the top of container 100. Central bore 108 has uppermost portion or chamber 110, upper portion or chamber 112, middle portion or chamber 114 and lower portion or chamber 116. Uppermost chamber 110 is larger in diameter than upper chamber 112, upper chamber 112 is smaller in diameter than middle chamber 114, and middle chamber 114 is larger in diameter than lower chamber 116. The interface between upper chamber 112 and middle chamber 114 forms flat, horizontal rim 118. The interface between middle rim 114 and lower chamber 116 forms flat, horizontal rim 120. Slightly-rounded edge 122, formed by the interface between flat rim 120 and lower chamber 116, serves as a valve seat. Side port 144 of valve housing 106 communicates with middle chamber 114. As seen in FIG. 8, side outlet nozzle 124 has lengthwise bore 126. Outlet nozzle 124 (see FIG. 8) is positioned in side port 144 of valve housing 106 so that bore 126 communicates with the lower region of middle chamber 108. Nozzle 124 is preferably externally threaded (162) for attachment to an external source (not shown) of a pressurized fluid, usually a pressurized gas. Any other suitable attachment means can be used to attach the external source of compressed gas to side nozzle 124.

Wall portion 128 of housing 106 encompasses the sides of uppermost chamber 110, which has a diameter that is larger than that of upper chamber 112. Wall portion 128 can be thinner than the rest of housing 106 because it is not subjected to the force caused by the compressed gas. Wall portion 128 is internally threaded (230) all but for its lower portion 170. Valve stem 130 has stem !34, rim 164, which is the top of stem 134, and handle 132, which is on top of rim 164. Bottom surface 172 is flat, conical (preferred) or similarly shaped in a curved manner. Stem 134 is generally positioned in uppermost chamber 110. Insert ring 166, which is externally threaded, is positioned in uppermost chamber 110 in threading engagement with internal threads 230 thereof. Insert ring 166 is also internally threaded, all but the lower portion of its internal bore 168. Insert ring 166 has a length of only about one-half that of wall portion 128. Stem 134 is externally threaded and, thereby, threadingly engages the internally-threaded portion of insert ring 166. In this manner and by means of handle 132, stem 134 can be rotatably turned in central bore 108 so as to advance up or down in uppermost chamber 110. The downward movement of stem 134 is stopped by contact of rim 164 with the top rim of insert ring 166 (which keeps stem 134 from advancing into upper chamber 112). Upper lip 142 of wall portion 128 is thinner than the internally-threaded portion of wall portion 128. When valve stem 130 is in place in central bore 108, upper lip 142 of wall portion 128 is crimped over as shown in FIG. 1 so as to restrict the upwards movement of rim 164 and, hence, of stem 134. Crimped upper lip 142 also prevents the easy removal of valve stem 130 from central bore 108 of housing 106 and provides ease and economy in the manufacture and assembly of valve 102.

While not preferred, different means can be used to retain valve stem 130 in central bore 108. For example, the upper edge of housing 106 can be externally threaded to receive an internally-threaded cap (not shown), which has a central hole therein through which stem 134 fits.

Diaphragm 174, in its normal shape, has central hemispherical portion 176 (upward facing) and rim 178. Rim 178 is preferably angled outwardly or upwardly and outwardly at between about zero to 60 degrees, most preferably at about 30 degrees, to the horizontal. See FIG. 1. Interface 180 between uppermost chamber 110 and upper chamber 112 is preferably inwardly or inwardly and downwardly angled at the same angle to the horizontal as is rim 178 of diaphragm 174. The angle helps provide a seal which can withstand 1000 psi or more without leaking or dislodgement. The bottom of rim 178 of diaphragm 174 mates with interface 180. FIG. 1 shows diaphragm 174 in place. Internal threading 230 of uppermost bore 110 extends slightly below the upper edge of rim 178. Bottom rim 182 is preferably inwardly and downwardly angled at the same angle to the horizontal as is rim 178 of diaphragm 174. The top of rim 178 of diaphragm 174 mates with interface 180. The inner edge of bottom rim 182 is curved to match the interface of rim 178 and central hemispherical portion 176 of diaphragm 174. Inner ring 166 is threaded downwards to hold diaphragm firmly in place (in a gas tight manner).

Diaphragm 174 is made of any durable, resilient, elastomeric material. The preferable material depends upon the end use of non-refillable valve 102. Diaphragm 174 can be constructed of, for example, Viton, which is a copolymer of hexafluoropropene and vinylidene fluoride, urethanes (polyurethanes), neoprene, buna-N (which is a vulcanizable synthetic rubber from butadiene with sodium as a catalyst), silicones, Hypalon (which is chlorosulfonated polyethylene) butyl rubber, EPDM (which is a terpolymer elastomer made from ethylene-propylene diene monomer) and natural rubber.

Figure 2:
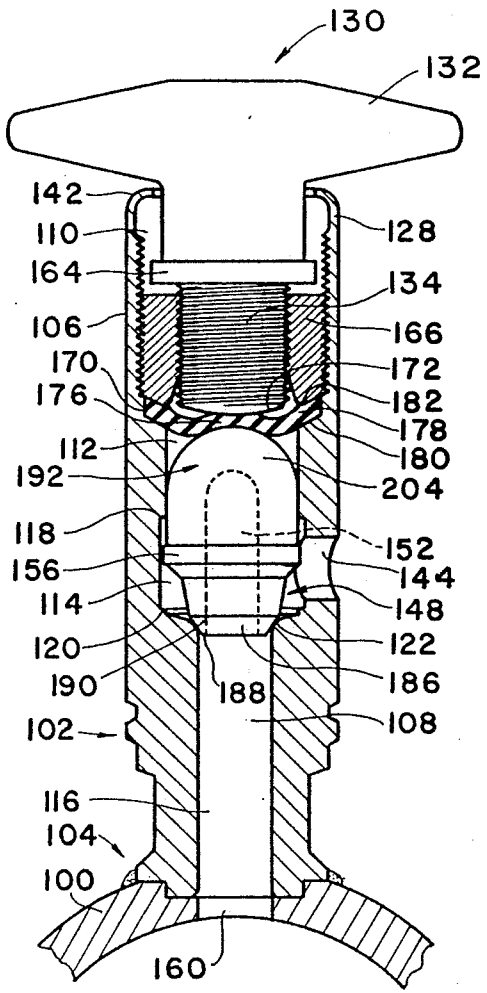
FIG. 2 is a longitudinal cross-sectional view of the non-refillable valve of FIG. 1 in its closed position, ready for use.
Figure 4:
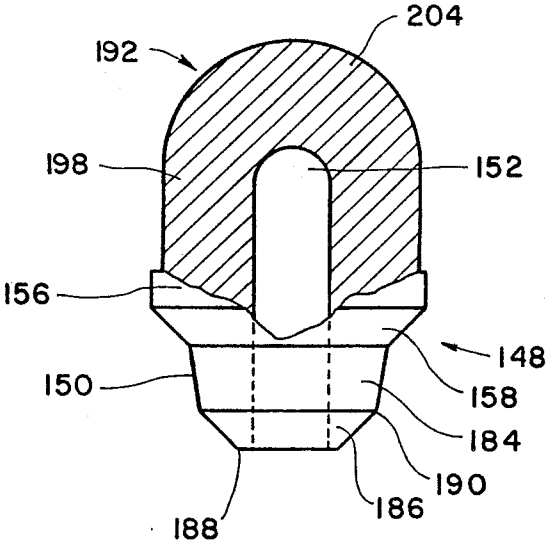
FIG. 4 is a cutaway side view of one version of the valve sealing member of FIG. 1.
Figure 5:
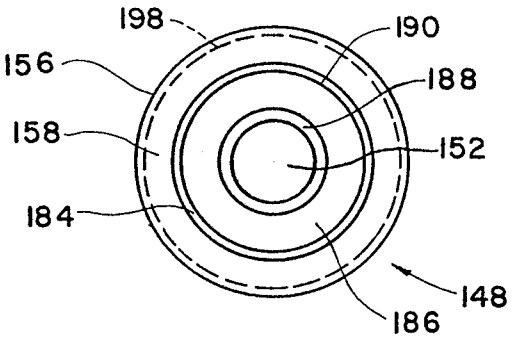
FIG. 5 is a bottom view of the valve sealing member of FIG. 4.

Referring to FIGS. 4 and 5, valve sealing member 148 contains lower body portion 150, upper extension portion 192 and centrally-located bore 152. Centrally-located bore 152 is vertically aligned and usually extends above top rim 156 into the upper region of lower portion 198 of extension portion 196 (but does not extend through the top of extension portion 196). It is important that centrally-located bore 152 extend past the top of rim 156. Valve sealing member 148 is a unitary object, preferably molded as such. Top rim 156 of lower body portion 150 has a diameter, when top rim 150 is in a noncompressed state, which is slightly less than the diameter of middle chamber 114 of central bore 108 and, when top rim 150 is in a non-compressed state, which is slightly larger than the diameter of top chamber 112. Below top rim 156 (which has a vertical face), body 150 has inwardly and downwardly slanted face 158 and then face 184, which is inwardly slanted at a much greater downward angle than is face 158. (See FIG. 1.) Edge 190, which is formed by the intersection of face 184 and face 186, is larger in diameter than the diameter of bottom chamber 116. Face or bottom rim 186 of body 150 is bevelled so as to be able to sealingly engage rim 122 (as shown in FIG. 2). Bottom surface 188 of body 150 is preferably flat and has a diameter which is less than the diameter of chamber 116. (The entrance to centrally-located bore 152 is located in bottom surface 196)

Lower portion 198 of extension portion 196 is cylindrical in shape and slidingly fits in upper portion 112 of central bore 108. The diameter of lower portion 198 is only slightly less than the diameter of the upper portion 112 of central bore 108 and less than the diameter of rim 156 of valve sealing member 148. Upper portion 204 of member 192 is hemispherical shaped. Upper portion 204 mates with central hemispherical portion 176 of diaphragm 174. See FIG. 1.

Valve sealing member 148 is made of compressible but resilient material or, in other words, an elastic material. Valve sealing member 148 is preferably made of a resilient or elastic plastic.

To assemble valve 102, valve sealing member 270 is inserted into uppermost chamber 110 with hemispherical portion 204 facing upwards. Insert ring 166 is threaded into uppermost chamber 110 and valve stem is then threaded into insert ring 166. Valve stem 130 is used to force valve seating member 148 into upper chamber 112. Sealing element 148 is made of a material which is slightly resilient, e.g., a plastic material, which allows such blocking element to be force fit into constriction region 112 in the central valve bore 108. Slanted face 158 helps pass sealing member 148 into upper chamber 112. Stem 134 and insert ring 166 are removed. Diaphragm 174 is inserted into uppermost chamber 110 onto the top of top hemispherical portion 204. Insert ring 166 is reinserted (threaded) into uppermost chamber 110 and applied tightly against rim 178. Stem 134 is reinserted into uppermost chamber 110 and threaded down to have lower surface 172 contact hemispherical portion 204 (and to force valve extension member 192 and valve sealing element 148 completely into place, if necessary, as shown in FIG. 1). The various parts are then in the open-valve position shown in FIG. 1. (Lower body portion 150 of valve sealing member 148 extends into middle chamber 114.) Upper lip 142 is crimped inwardly to seal rim 164 and stem 134 in uppermost chamber 110. In this manner, it is difficult to remove valve sealing member 148 from central bore 108. At this point in time, top rim portion 156 of sealing member 148 is compressed inwardly. As top rim portion 156 is resilient or elastic, top rim portion 148 exerts a force against the surface of upper chamber 112 and thereby prevents sealing member 148 from falling into middle chamber 114 (even if valve 102 is dropped, before being attached to container 100).

In operation, non-refillable valve 102 is initially in the open, ready-for-filling position shown in FIG. 1. The compressed gas flows from its source through bore 126, middle chamber 114, lower chamber 116 and into pressure vessel 100. Once pressure container 100 is filled knob 132 is screwed inwardly to force sealing member 148 completely into middle chamber 114 (hemispherical portion 176 is depressed). In this manner, the effect of compressed top rim portion 156 can be overcome. Once sealing member 148 is in middle chamber 114, compressed top rim portion 156 resiliently returns to its original non-compressed size (and shape). Since the diameter across top rim portion 156 is greater than the diameter of upper chamber 112, lower body portion 150 of sealing member 148 cannot reenter upper chamber 112. Any upwards pull on or pressure against sealing member 148 would not cause the reentry of sealing member 148 into upper chamber 112 (an exceptionally large upwards pulling force would tend to damage top rim portion 156). If valve stem 130 and diaphragm 174 are removed, it is still basically impossible to remove sealing member 148 out of central bore 108. The size of sealing member 148 is made large enough so that it cannot move more than a few degrees from its vertical axis even if valve stem 130 has been removed from central bore 108

Figure 3:
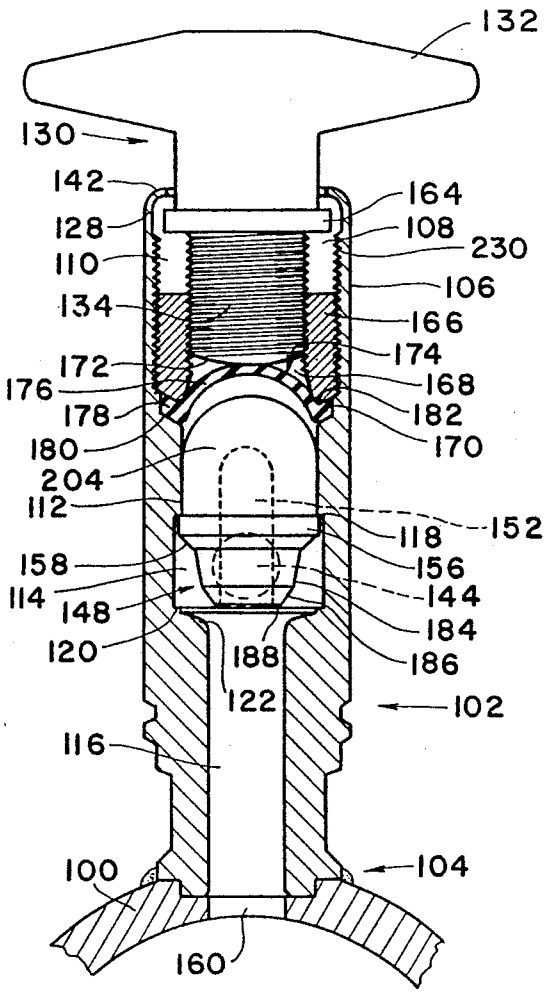
FIG. 3 is a longitudinal cross-sectional view of the non-refillable valve of FIG. 1 in its discharge position.

FIG. 2 shows valve 102 in the closed position after container 100 has been filled. Hemispherical portion 176 is in a depressed position. To allow the controlled discharge of some or all of the contents of container 100, knob 132 is screwed outwardly as far as necessary to allow the rate of discharge desired. See FIG. 3. Hemispherical portion 176 returns to its full upward position (or partially, if valve stem 130 is only partially screwed upward). The diaphragm reverses (i.e., turns inside out) instead of stretching, which extends the life of the diaphragm. Referring to FIG. 3, sealing member 148, by the pressure of the pressurized gas exiting from container 100, can freely be moved up when valve stem 130 is moved to the up or open position. To stop the discharge of the contents of container 100, valve screw 130 is screwed downwards to place sealing member 148 back into the closed or sealing position shown in FIG. 2.

After the pressurized gas has been completely discharged from container 100, non-refillable valve 102 automatically prevents any refilling or reuse of container 100. Refilling after the partial discharge of pressurized gas or an attempt to insert a further amount of pressurized gas to an already filled container 100 is automatically prevented by valve sealing element 148.

Valve sealing member 148 and diaphragm 174 are the only non-metallic parts (possibly also knob 132) and they should be made of materials which are chemically resistant to the compressed fluid used in container 100. The rest of the parts of valve 102 should be made of very strong metal, such as steel. Stainless steel should be used if the pressurized gas is corrosive.

One of the important features of the invention is the location of outlet nozzle 124 (i.e., bore 126) in the lower portion of middle chamber 114 below top rim 156 of sealing member 148 when sealing member 148 is in the fill position (a shown in FIG. 1). In such arrangement, sealing member 148 does not interfere with the compressed gas flow path into container 100 during the filling operation. Of course, this assumes that the height of bottom chamber is of sufficient magnitude to keep bottom surface 188 of sealing member 148 a reasonable distance above seat 122.

When sealing member 148 is seated on rim 122, top surface 156 of sealing member 148 is preferably below the longitudinal plane passing through the top of bore 126 of side nozzle 124. This arrangement easily allows the entering compressed gas to reach the area above sealing member 148.

Bottom surface 188 of sealing member 148 helps to provide a large area on the bottom surfaces of sealing member 148 during discharge. Bottom surface 188 is hidden to gas pressure during any attempt at refilling container 100 once sealing means 148 has seated.

Figure 6:
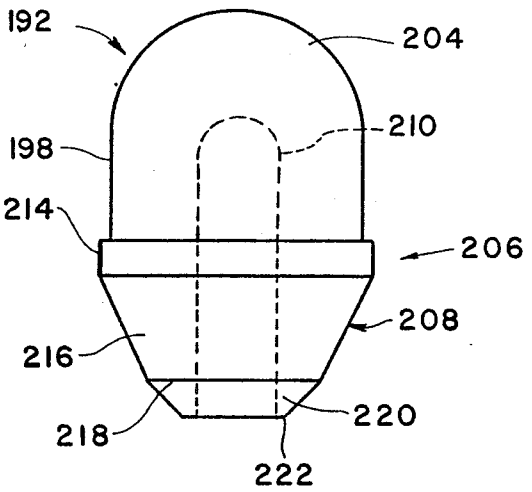
FIG. 6 is a side view of a further version of the valve sealing member of the invention.
Figure 7:
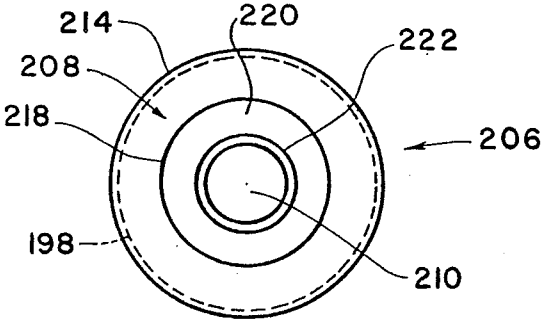
FIG. 7 is a bottom view of the valve sealing member of FIG. 6.

Referring to FIGS. 6 and 7, valve sealing member 206 is an alternative to valve sealing member 148 and is easier to mold. Valve sealing member 206 contains lower body portion 208, upper extension portion 192 and centrally-located bore 210. Centrally-located bore 210 is vertically aligned and usually extends above top rim 214 into the upper region of middle portion 198 of extension portion 196 (but does not extend through the top of extension portion 196). It is important that centrally-located bore 210 extend past the top of rim 214. Top rim 214 of body 208 has a diameter, when top rim 214 is in a non-compressed state, which is slightly less than the diameter of middle chamber 114 of central bore 108 and which is slightly larger than the diameter of top chamber 112. Below top rim 212 (which has a vertical face), body 208 has inwardly and downwardly slanted face 216. Edge 218, which is formed by the intersection of face 216 and face 220, is larger in diameter than the diameter of bottom chamber 116. Face or bottom rim 220 of body 208 is bevelled so as to be able to sealingly engage rim 122. Bottom surface 222 of body 208 is preferably flat and has a diameter which is less than the diameter of chamber 116. (The entrance to centrally-located bore 210 is located in bottom surface 222.) Preferably centrally-located bore 214 extends past rim 214, which provides a degree of flexibility to that region of valve sealing member 206 for insertion without any significant reduction in the extreme difficulty of forcing top rim 214 back into upper chamber 112.

FIG. 8 shows a very preferred embodiment of side outlet nozzle 124 (which is the embodiment shown in FIGS. 1 to 4 and 12 to 14). Side port 144 is located in the bottom of middle chamber 114. Side Port 144 has stepped portions 238, 240 and 242, each having a larger diameter than the next inwardly stepped portion. Side outlet nozzle 124 contains horizontal bore 244, which communicates with middle chamber 114 via stop portion 242 of side port 144. The end (246) of nozzle 124 is bevelled. The diameter of nozzle 124 is such that it snugly fits within middle step portion 240 with bevel 246 not extending past the interface of step portion 240 and 242. Nozzle 124 can be welded to housing 106 utilizing the ring groove formed by step portion around nozzle 124. Side outlet nozzle 124 has external end threads 248.

Figure 9:
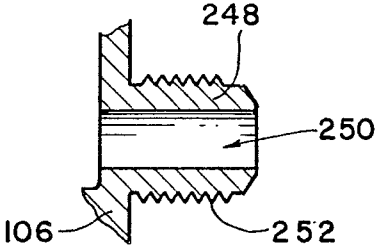
FIG. 9 is a fragmentary cross-sectional view of another version of the side port of the valve of the invention.

FIG. 9 shows side outlet nozzle 248 formed as a unitary part of housing 106. Side outlet nozzle 248 contains horizontal bore 250 and has external end threads 252.

The use of separate outlet nozzle 124 (as in FIG. 8) provides increased ease of manufacture and assembly and increased cost savings over the embodiment shown in FIG. 9.

Figure 12:
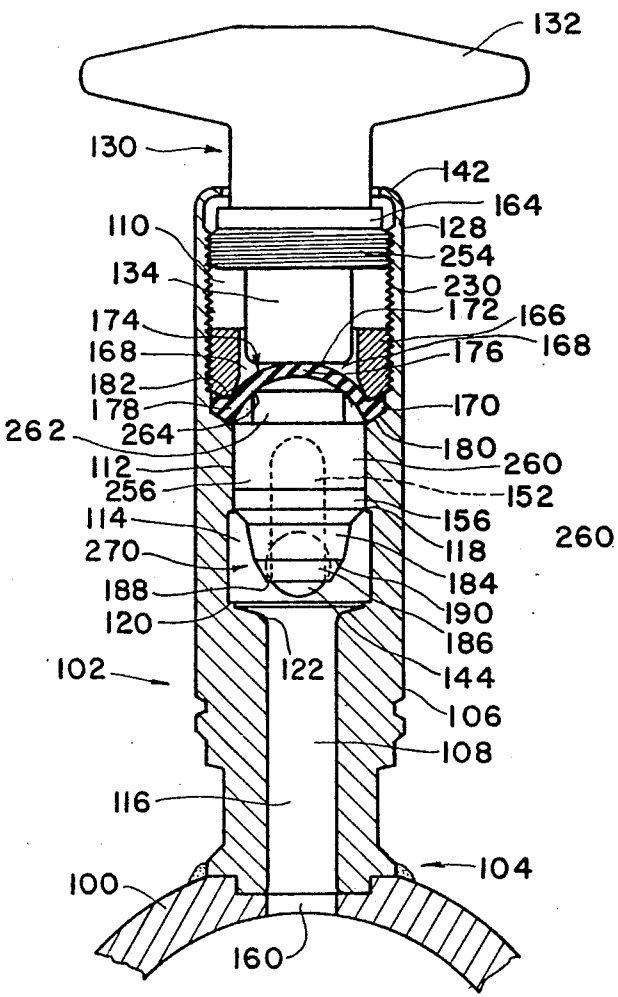
FIG. 12 is a longitudinal cross-sectional view of the non-refillable valve of the invention in its filling position, incorporating the valve sealing member of FIG. 10.

Referring to FIG. 12, pressure container or pressure container system 100 is provided with non-refillable valve 102 for the filling and selective emptying of container 100. Valve 102 can be welded, threaded or otherwise affixed to container 100, as shown in FIG. 12 at 104 (the welding mode is shown). The preferred attachment means is set out in FIG. 14. In FIG. 12 valve 102 is provided with housing 106 which has central bore 108. Central bore 108 communicates with the interior of container 100 via hole 160 in the top of container 100. Central bore 108 has uppermost portion or chamber 110, upper portion or chamber 112, middle portion or chamber 114 and lower portion or chamber 116. Uppermost chamber 110 is larger in diameter than upper chamber 112, upper chamber 112 is smaller in diameter than middle chamber 114, and middle chamber 114 is larger in diameter than lower chamber 116. The interface between upper chamber 112 and middle chamber 114 forms flat, horizontal rim 118. The interface between middle rim 114 and lower chamber 116 forms flat, horizontal rim 120. Slightly-rounded edge 122, formed by the interface between flat rim 120 and lower chamber 116, serves as a valve seat. Side port 144 of valve housing 106 communicates with middle chamber 114. As seen in FIG. 8, side outlet nozzle 124 has lengthwise bore 126. Outlet nozzle 124 (see FIG. 8) is positioned in side port 144 of valve housing 106 so that bore 126 communicates with the lower region of middle chamber 108. Nozzle 124 is preferably externally threaded (162) for attachment to an external source (not shown) of a pressurized fluid, usually a pressurized gas. Any other suitable attachment means can be used to attach the external source of compressed gas to side nozzle 124.

Wall portion 128 of housing 106 encompasses the sides of uppermost chamber 110, which has a diameter that is larger than that of upper chamber 112. Wall portion 128 can be thinner than the rest of housing 106 because it is not subjected to the force caused by the compressed gas. Wall portion 128 is internally threaded (230) all but for its lower portion 170. Valve stem 130 has stem 134, externally-threaded portion 254, rim 164, which is the top of portion 254, and handle 132, which is on top of rim 164. Bottom surface 172 is flat, conical or similarly shaped in a curved manner. Stem 134 is generally positioned in uppermost chamber 110. Insert ring 166, which is externally threaded, is positioned in uppermost chamber 110 in threading engagement with internal threads 230 thereof. Insert ring 166 has internal bore 168. Insert ring 166 usually has a length of less than one-half that of wall portion 128. Externally-threaded portion 254 has a diameter of sufficient value that it threadingly engages internal threads 230 of uppermost chamber 110. In this manner and by means of handle 132, stem 134 can be rotatably turned in central bore 108 so as to advance up or down in uppermost chamber 110. The downward movement of stem 134 is stopped by contact of the bottom surface of part 254 with the top rim of insert ring 166 (which keeps it from advancing into upper chamber 112). Upper lip 142 of wall portion 128 is thinner than the internally-threaded portion of wall portion 128. When valve stem 130 is in place in central bore 108, upper lip 142 of wall portion 128 is crimped over as shown in FIG. 12 so as to restrict the upwards movement of rim 164 and, hence, of stem 134. Crimped upper lip 142 also prevents the easy removal of valve stem 130 from central bore 108 of housing 106 and provides ease and economy in the manufacture and assembly of valve 102.

While not preferred, different means can be used to retain valve stem 130 in central bore 108. For example, the upper edge of housing 106 can be externally threaded to receive an internally-threaded cap (not shown), which has a central hole therein through which stem 134 fits.

Diaphragm 174, in its normal shape, has central hemispherical portion 176 (upward facing) and rim 178. Rim 178 is preferably angled outwardly or upwardly and outwardly at between about zero to 60 degrees, most preferably at about 30 degrees to the horizontal. See FIG. 12. Interface 180 between uppermost chamber 110 and upper chamber 112 is preferably inwardly or inwardly and downwardly angled at the same angle to the horizontal as is rim 178 of diaphragm 174. The bottom of rim 178 of diaphragm 174 mates with interface 180. FIG. 12 shows diaphragm 174 in place. Internal threading 230 of uppermost bore 110 extends slightly below the upper edge of rim 178. Bottom rim 182 is preferably inwardly and downwardly angled at the same angle to the horizontal as is rim 178 of diaphragm 174. The top of rim 178 of diaphragm 174 mates with interface 180. The inner edge of bottom rim 182 is curved to match the interface of rim 178 and central hemispherical portion 176 of diaphragm 174. Inner ring 166 is threaded downwards to hold diaphragm firmly in place (in a gas tight manner).

Diaphragm 174 is made of any durable, resilient, elastomeric material. The preferable material depends upon the end use of non-refillable valve 102. Diaphragm 174 can be constructed of, for example, Viton, which is a copolymer of hexafluoropropene and vinylidene fluoride, urethanes (polyurethanes), neoprene, buna-N (which is a vulcanizable synthetic rubber from butadiene with sodium as a catalyst), silicones, Hypalon (which is chlorosulfonated polyethylene) butyl rubber, EPDM (which is a terpolymer elastomer made from ethylene-propylene diene monomer) and natural rubber.

Figure 10:
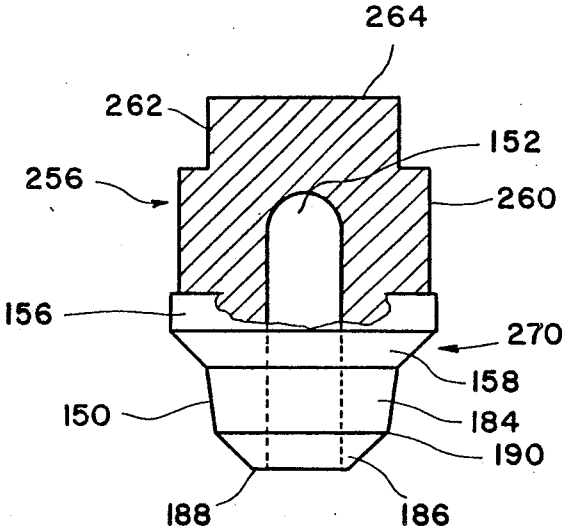
FIG. 10 is a partially cutaway side view of a further version of the valve sealing member of the invention.
Figure 11:
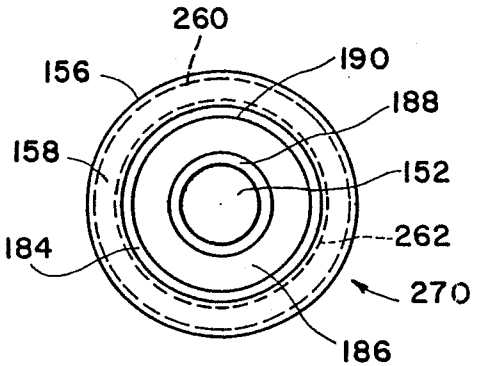
FIG. 11 is a bottom view of the valve sealing member of FIG. 11.
Figure 13:
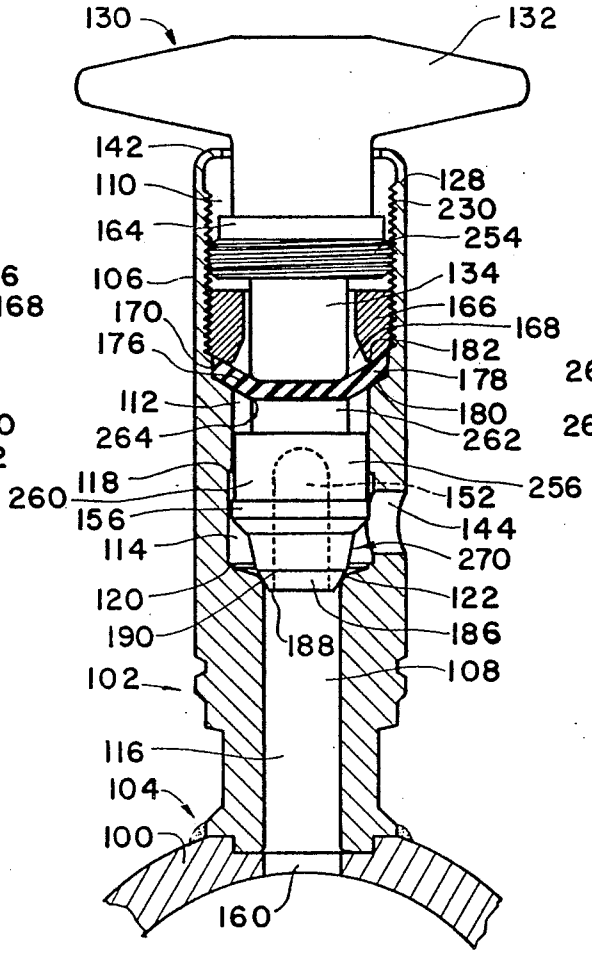
FIG. 13 is a longitudinal cross-sectional view of the non-refillable valve of FIG. 12 in its closed position, ready for use.

Referring to FIGS. 10 and 11, valve sealing member 270 contains body 150, upper extension portion 256 and centrally-located bore 152. Centrally-located bore 152 is vertically located and usually extends above top rim 156 into the upper region of middle portion 260 of extension portion 256 (but does not extend through the top of extension portion). It is important that centrally-located bore 152 extend past the top of rim 156. Valve sealing member 270 is a unitary object, preferably molded as such. Top rim 156 of lower body portion 150 has a diameter, when top rim 150 is in a noncompressed state, which is slightly less than the diameter of middle chamber 114 of central bore 108 and, when top rim 150 is in a non-compressed state, which is slightly larger than the diameter of top chamber 112. Below top rim 156 (which has a vertical face), body 150 has inwardly and downwardly slanted face 158 and then face 184, which is inwardly slanted at a much greater downward angle than is face 158. (See FIG. 12.) Edge 190, which is formed by the intersection of face 184 and face 186, is larger in diameter than the diameter of bottom chamber 116. Face or bottom rim 186 of body 150 is bevelled so as to be able to sealingly engage rim 122 (as shown in FIG. 13). Bottom surface 188 of body 150 is preferably flat and has a diameter which is less than the diameter of chamber 116. (The entrance to centrally-located bore 152 is located in bottom surface 188.)

Lower region 260 of extension portion 256 is cylindrical in shape and slidingly fits in upper portion 112 of central bore 108. The diameter of lower region 260 is only slightly less than the diameter of the upper chamber 112 of central bore 108 and is less than the non-compressed diameter of rim 156 of valve sealing member 270. Upper portion 262 of member 256 is cylindrical shaped and is smaller in diameter than lower portion 260.

Valve sealing member 270 is made of compressible but resilient material or, in other words, an elastic material. Valve sealing member 270 is preferably made of a resilient or elastic plastic.

To assemble valve 102, valve sealing member 270 is inserted into uppermost chamber 110 with hemispherical portion 204 facing upwards. Valve stem 130 is then threaded into uppermost chamber 110. Valve stem 130 is used to force valve sealing member 270 into upper chamber 112. Sealing element 270 is made of a material which is slightly resilient, e.g., a plastic material, which allows such blocking element to be force fit into constriction region 112 in the central valve bore 108. Slanted face 158 helps pass sealing member 270 into upper chamber 112. Valve stem 130 is removed. Diaphragm 174 is inserted into uppermost chamber 110. Insert ring 166 is threaded into uppermost chamber 110 and applied tightly against rim 178. Stem 134 is reinserted into uppermost chamber 110 and threaded down to have lower surface 172 contact hemispherical portion 204 (and to force valve sealing element 270 completely into place, if necessary, as shown in FIG. 12). The various parts are then in the open-valve position shown in FIG. 12. (Lower body portion 150 of valve sealing member extends into upper chamber 114.) Upper lip 142 is crimped inwardly to seal rim 164 and stem 134 in uppermost chamber 110. In this manner, it is difficult to remove valve sealing member 270 from central bore 108. At this point in time, top rim portion 156 of sealing member 270 is compressed inwardly. As top rim portion 156 is resilient or elastic, top rim portion 156 exerts a force against the surface of upper chamber 112 and thereby prevents sealing member 270 from falling into middle chamber 114 (even if valve 102 is dropped, before being attached to container 100).

In operation, non-refillable valve 102 is initially in the open, ready-for-filling position shown in FIG. 12. The compressed gas flows from its source through bore 126, middle chamber 114, lower chamber 116 and into pressure vessel 100. Once pressure container 100 is filled, knob 132 is screwed inwardly to force sealing member 270 completely into middle chamber 114 (hemispherical portion 176 is depressed). In this manner, the effect of compressed top rim portion 156 can be overcome. Once sealing member 270 is in middle chamber 114, compressed top rim portion 156 resiliently returns to its original non-compressed size (and shape). Since the diameter across top rim portion 156 is greater than the diameter of upper chamber 112, lower body portion 150 of sealing member 270 cannot reenter upper chamber 112. Any upwards pull on or pressure against sealing member 270 would not cause the reentry of sealing member 270 into upper chamber 112 (an exceptionally large upwards pulling force would tend to damage top rim portion 156). If valve stem 130 and diaphragm 174 are removed, it is still basically impossible to remove sealing member 270 out of central bore 108. The size of sealing member 270 is made large enough so that it cannot move more than a few degrees from its vertical axis even if valve stem 130 has been removed from central bore 108.

Figure 14:
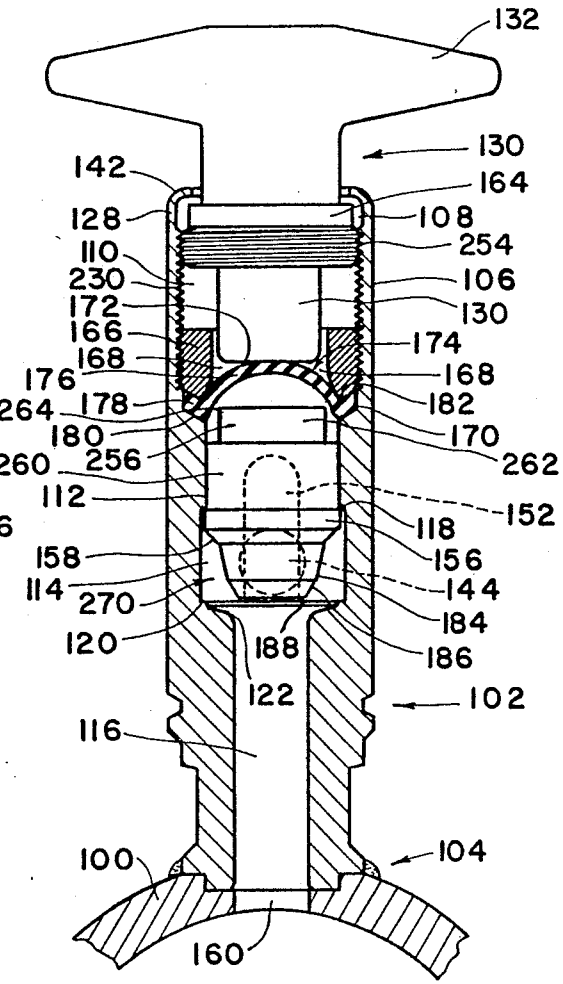
FIG. 14 is a longitudinal cross-sectional view of the non-refillable valve of FIG. 12 in its discharge position.

FIG. 13 shows valve 102 in the closed position after container 100 has been filled. Hemispherical portion 176 is in a depressed position against the top surface of upper portion 262 of valve extension member 256. To allow the controlled discharge of some or all of the contents of container 100, knob 132 is screwed outwardly as far as necessary to allow the rate of discharge desired. See FIG. 14. Hemispherical portion 176 returns to its full upward position (or partially, if valve stem 130 is only partially screwed upward). Referring to FIG. 14, sealing member 270, via post 152, can freely be moved up by the pressure of the pressurized gas exiting from container 100 when valve stem 130 is moved into the up or open position. To stop the discharge of the contents of container 100, valve screw 130 is screwed downwards to place sealing member 270 back into the closed or sealing position shown in FIG. 13.

After the pressurized gas has been completely discharged from container 100, non-refillable valve 102 automatically prevents any refilling or reuse of container 100. Refilling after the partial discharge of pressurized gas or an attempt to insert a further amount of pressurized gas to an already filled container 100 is automatically prevented by valve sealing element 270.

Sealing member 270 and diaphragm 174 are the only non-metallic parts (possibly also knob 132) and they should be made of materials which are chemically resistant to the compressed fluid used in container 100. The rest of the parts of valve 102 should be made of very strong metal, such as steel. Stainless steel should be used if the pressurized gas is corrosive.

Figure 15:
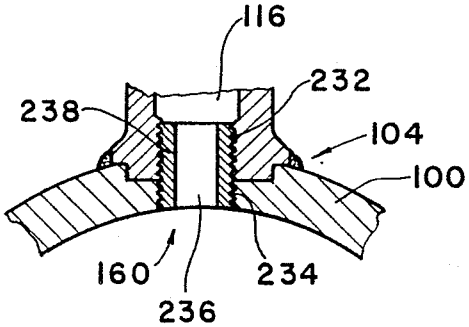
FIG. 15 is a cutaway of one version of the attachment of the non-refillable valve of FIG. 1 with a pressure container.

Referring to FIG. 15, the lower part of lower chamber 116 of central bore 108 is internally threaded (232). Externally-threaded nipple 238 is threaded into hole 160, which is internally-threaded (234), of container 100. The lower part of lower chamber 116 is threaded onto the upper part of externally-threaded nipple 238. Well bead 104 is then applied. Central bore 108 communicates with the interior of container 100 via central passage way 236 in nipple 236.

Although the invention non-refillable valve has been primarily described above for compressed gas containers, the invention non-refillable valve can be used with pressure fluid containers, such as, pressurized liquid containers.

The valve and blocking element (valve sealing member) are configured such that the blocking element can be irreversibly moved to a position in which the valve permits escape of fluid under pressure exerted from the inside of the container, but which automatically closes in response to exposure to an external pressure greater than the pressure inside the container. The valve itself is formed of a valve housing and a stem to open and close the valve. The stem is configured to force the blocking element (via the diaphragm) from the initial to the final location.

The material out of which the blocking element is made is not critical, although it must be sufficiently flexible so as to allow for compression or flexing while in the constricted portion, and then re-expansion when finally positioned in the final location. Resilient plastics are preferred, provided such plastics are inert to the pressurized gas used in the container.

The invention valve does not encompass the valve entry side port being located above the constricted portion of the valve control bore (the sealing element does not contain any bypass holes). The use of the invention valve with a top side port (with sealing elements which do not contain any bypass holes) would be inoperable because the sealing element is initially in the compressed state in the constricted region of the valve central bore and, therefore, the container could not be filled. The pressurized gas would have no unblocked path from the upper located side port into the container. If the pressurized gas forced the compressed blocking element out of the constricted region, initial filling would then be blocked. (The use of a sealing element with at least one bypass hole, i.e., which is not a slot and which does not extend into the seating portion of the sealing element, would be a very impractical embodiment because filling would be very slow unless the holes were relatively quite large.)

The following are some of the advantages of the invention approach of using a side port located below the blocking element during filling:

1. The overall height is approximately the same as current standard valves in use. This is important to avoid the redesign of handles and cartons, and avoids increased cost regarding such matter.

2. A top port design, by its nature, restricts the flow during filling and increases the costs to fill the cylinder—this is not a problem with the invention valve.

Concerning the invention valve:

1. The blocking element of the invention valve is above the filling port during the filling operation, providing unrestricted flow.

2. The shape of and affixing arrangement of the resilient diaphragm provides a self sealing diaphragm that can withstand high pressures without failing, leaking or stretching.

3. The design, by its nature, allows for a minimum height without redesign of the container handles or cartons and the manufacture of the valve.

4. The valve design is such that during the discharge of the cylinder the flow is little restricted, allowing maximum discharge rate.

5. It is obvious with the benefits of fill rate, economics, and ability, that the invention valve provides the industry with a valve without handle or carton redesign.

Although the invention has been described with reference to some preferred embodiments, it is not intended that the broad scope of the herein-described non-refillable valve of the invention be limited thereby but that some modifications and variations are intended to be included within the spirit and scope of the invention as defined by the following claims.

What is claimed is:

1. Non-refillable valve for a pressure container, comprising:

(a) a housing, having a central bore which has a middle portion, a lower portion that is narrower than the middle portion of said central bore, an upper portion that is narrower than said middle portion of said central bore and an uppermost portion that is wider than said upper portion of said central bore, and having a side port which communicates with the lower region of said middle portion of said central bore, the lower end of said housing being adapted to sealingly engage said pressure container in a manner which provides communication between said pressure container and said lower portion of said central bore;

(b) a nozzle, having a bore therein which communicates with the atmosphere, said nozzle being positioned on the side of said housing and being in communication with said middle portion of said central bore via said side port in said housing;

(c) an insert ring positioned in said uppermost portion of said central bore;

(d) valve stem means positioned in upper portion of said central bore in a rotatable manner by which the valve stem means is advanced back and/or forth in said central bore;

(e) a diaphragm, having a central hemispherical or curved portion and a rim, the convex portion of the central portion facing the valve stem, the end of said insert ring contacting said rim of said diaphragm so as to hold it in position against the interface between said uppermost portion and said upper portion of said central bore; and (f) a resilient valve sealing member which has a lower body portion, an upper extension portion and a centrally-located bore which does not extend through the top of the valve sealing member, said extension portion having a top hemispherical, curved or flat portion which is in mating relationship with or contacting, respectively, said hemispherical or curved portion of said diaphragm, said body portion having a top rim portion which has a lateral dimension which is larger than the lateral dimension of said upper portion of said central bore of said housing and which is less than the lateral dimension of the middle portion of said central bore of said housing, said body portion having a bottom seating portion which is capable of seating at or on the interface of said middle portion and bottom portion of said central bore of said housing, said top rim portion not containing any indentations, and said body portion not containing any arms, said top rim portion of said valve sealing member being compressingly positioned in said upper portion of said central bore when said valve is inactive or being filled, said valve sealing member being pushed into said middle portion by means of said valve stem means via said diaphragm when said valve is placed in the active position, said valve sealing member being seated against said interface between said middle and lower portions of said central bore when said valve is closed, said sealing member being positioned in said middle chamber above a said seating interface with said valve is used for discharge of said container, and said sealing member sealingly engaging said seating interface when refill of said container with pressurized fluid is attempted.

2. Non-refillable valve as claimed in claim 1 wherein said bore in said nozzle runs lengthwise through said nozzle.

3. Non-refillable valve as claimed in claim 1 wherein said nozzle is positioned in said side port in said housing.

4. Non-refillable valve as claimed in claim 1 wherein said pressure container is a pressurized gas container.

5. Non-refillable valve as claimed in claim 4 wherein said pressurized gas container is a pressurized gas cylinder.

6. Non-refillable valve as claimed in claim 1 wherein said valve stem means is mounted in said insert in said upper portion of said central bore in a screwable manner.

7. Non-refillable valve as claimed in claim 1 wherein said valve stem means has an externally-located knob for turning said valve stem means.

8. Non-refillable valve as claimed in claim 1 wherein said valve sealing member is made of a resilient plastic.

9. Non-refillable valve as claimed in claim 1 wherein the bottom rim of the body portion is bevelled.

10. Non-refillable valve as claimed in claim 1 wherein said rim of said diaphragm is outwardly or upwardly and outwardly slanted, the bottom surface of said insert rim and the interface between said upper portion and said uppermost portion of said central bore being correspondingly slanted.

* * * * *